US009365913B2

(12) United States Patent
Imaizumi et al.

(10) Patent No.: US 9,365,913 B2
(45) Date of Patent: Jun. 14, 2016

(54) HIGH-HARDNESS HARDFACING ALLOY POWDER

(75) Inventors: Kaoru Imaizumi, Aichi (JP); Shigeki Ueta, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 723 days.

(21) Appl. No.: 13/463,333

(22) Filed: May 3, 2012

(65) Prior Publication Data

US 2012/0288399 A1 Nov. 15, 2012

(30) Foreign Application Priority Data

May 9, 2011 (JP) ..... 2011-104318

(51) Int. Cl.
*C22C 1/04* (2006.01)

(52) U.S. Cl.
CPC ..... *C22C 1/0433* (2013.01); *C21D 2251/04* (2013.01)

(58) Field of Classification Search
CPC ... C22C 1/0433; C22C 19/07; C21D 2251/04
USPC ..... 75/246
See application file for complete search history.

(56) References Cited

U.S. PATENT DOCUMENTS

| | | | | |
|---|---|---|---|---|
| 3,410,732 | A * | 11/1968 | Smith | 148/425 |
| 2010/0189588 | A1 | 7/2010 | Kawatsu et al. | |

FOREIGN PATENT DOCUMENTS

| | | | |
|---|---|---|---|
| CN | 1038609 | | 1/1990 |
| CN | 101505910 | | 8/2009 |
| JP | 62-33090 | A | 2/1987 |
| JP | 2-92495 | A | 4/1990 |
| JP | 5-84592 | A | 4/1993 |
| JP | 7-126782 | A | 5/1995 |
| JP | 9-271983 | | 10/1997 |
| JP | 2001-123238 | A | 5/2001 |

OTHER PUBLICATIONS

Japanese Office Action for JP Application No. 2011-104318, which was mailed on Jan. 27, 2015; along with an English translation thereof.

Chinese Office Action for CN Application No. 201210143047.4, which was dated Feb. 28, 2015, along with an English translation thereof.

* cited by examiner

*Primary Examiner* — Weiping Zhu
(74) *Attorney, Agent, or Firm* — Greenblum & Bernstein, P.L.C.

(57) ABSTRACT

The present invention relates to a high-hardness hardfacing alloy powder, containing: 0.5<C≤3.0 mass %, 0.5≤Si≤5.0 mass %, 10.0≤Cr≤30.0 mass %, and 16.0<Mo≤40.0 mass %, with the balance being Co and unavoidable impurities, wherein a total amount of Mo and Cr satisfies 40.0≤Mo+Cr≤70.0 mass %. The high-hardness hardfacing alloy powder according to the present invention may further contain at least one element selected from the group consisting of: Ca≤0.03 mass %, P≤0.03 mass %, Ni≤5.0 mass % and Fe≤5.0 mass %. The high-hardness hardfacing alloy powder according to the present invention can be employed for build-up welding of a face part of a valve used in various internal combustion engines, automotive engines, steam turbines, heat exchangers, heating furnaces and the like.

6 Claims, No Drawings

HIGH-HARDNESS HARDFACING ALLOY POWDER

FIELD OF THE INVENTION

The present invention relates to a high-hardness hardfacing alloy powder. More specifically, the present invention relates to a high-hardness hardfacing alloy powder employed for build-up welding of a face part of a valve used in various internal combustion engines, automotive engines, steam turbines, heat exchangers, heating furnaces and the like.

BACKGROUND OF THE INVENTION

Build-up welding indicates a welding method of welding a metal on a base material surface. The build-up welding is performed to impart characteristics such as wear resistance and corrosion resistance to the base material surface. For example, the face part of an engine valve is repeatedly put into contact with a valve seat and is thus required to have high wear resistance. On the other hand, a material having high wear resistance is generally poor in toughness, and this makes it difficult to produce the entire valve by using such a material having high wear resistance. For this reason, it has been done to use a material having high toughness for the engine valve and build up a material having high wear resistance on the face part of the valve.

Various methods have been known as the build-up welding method, but in usages requiring automation of the process, for example, a plasma powder welding method or a laser powder welding method each using an alloy powder as the filler metal has been generally employed. Also, various materials has been used for the hardfacing alloy according to the purpose, but in the case of applying an overlay for the purpose of imparting wear resistance, Co-base alloys such as Co—Cr—W alloy (for example, STELLITE (registered trademark) #6) and Co—Cr—Mo—Si alloy (for example, TRIBALOY (registered trademark) 400) have been used as the hardfacing alloy. In relation to such a Co-base alloy for build-up welding, various proposals have been heretofore proposed.

For example, Patent Document 1 discloses a Co-base alloy powder for powder hardfacing, having a spherical shape and having an oxygen amount of 0.01 to 0.50 wt % and a nitrogen amount of 0.30 wt % or less.

The document above describes that by setting the oxygen amount to 0.01 wt % or more and the nitrogen amount to 0.30 wt % or less, a blow hole in the overlay metal can be eliminated.

Patent Document 2 discloses a powder for build-up welding of an engine valve, containing, on the weight basis, C: from 2 to 2.5%, Si: from 0.6 to 1.5%, Ni: from 20 to 25%, Cr: from 22 to 30%, W: from 10 to 15%, Al: from 0.0005 to 0.05%, B: from 0.0001 to 0.05%, and O: from 0.005 to 0.05%, with the balance being Co and unavoidable impurities.

The document above describes that when the contents of C, Cr and W are increased to certain values, the same effect as the carburizing effect is exerted even when inactive gas-shielded welding is used.

Patent Document 3 discloses a sub-combustion chamber cap for a diesel engine, which is made of a Co-base heat-resistant alloy containing, in terms of wt %, Cr: from 20.0 to 30.0%, W and/or Mo: from 3.0 to 16.0%, Si: from 0.5 to 1.5%, Mn: from 0.01 to 0.5%, and C: from 0.1 to 1.5%, with the balance being Co and unavoidable impurities, though this is not an alloy powder for build-up welding.

The document above describes that by optimizing the alloy composition, high-temperature oxidation resistance and thermal shock resistance are improved.

Patent Document 4 discloses a cobalt-based hardfacing alloy containing, in terms of weight ratio, Cr: from 10 to 40%, Mo: from more than 10% to 30%, W: from 1 to 20%, Si: from 0.5 to 5.0%, C: from 0.05 to 3.0%, 0: from 0.01 to 0.1%, Al: from 0.001 to 0.12%, Fe: 30% or less, Ni: 20% or less, and Mn: 3% or less, with the balance being Co and unavoidable impurities (provided that the Co amount is from 30 to 70 wt %).

The document above describes that:

(1) by increasing the Fe amount, toughness is enhanced and at the same time, wear resistance and opponent aggression are improved, (2) by adding Al and controlling the O content, the hardfacing effect is improved and at the same time, generation of a blow hole at the hardfaced area can be suppressed, and (3) by further incorporating B, external intrusion of O can be prevented, the hardfacing effect is improved and at the same time, the bead shape is enhanced.

Furthermore, Patent Document 5 discloses a Co-base saw tip composed of a 1.5C-29Cr-8.5Mo—Co alloy, a 2.5C-33Cr-18Mo—Co alloy, or a 2.2C-32Cr-1.3W-18Mo—Co alloy.

The document above describes that when a part or the whole of W in a Co—Cr—W alloy is replaced by Mo, formation of a carbide is accelerated and high corrosion resistance in an acid environment is imparted.

Hardfacing alloys are sometimes required to have a plurality of characteristics according to the purpose. For example, in the case of applying hardfacing to the face part of an engine valve, not only wear resistance but also ductility to a certain extent are required for the hardfacing alloy. This is because when the ductility of the hardfacing alloy is low, cracking is readily generated during hardfacing and the productivity is reduced.

Out of the above-described Co-base alloys, the Co—Cr—W alloy has high ductility and good weld cracking sensitivity, because the hardening phase is a Cr-based carbide. However, the Co—Cr—W alloy has a problem that the wear resistance is relatively low and the wear volume during use is large.

On the other hand, the Co—Cr—Mo—Si alloy is excellent in the wear resistance, because the hardening phase is a Laves phase ($Co_3Mo_2Si$). However, the Co—Cr—Mo—Si alloy has a problem that the ductility is low and cracking is readily generated during hardfacing.

Also, when a certain element (for example, W) is excessively added to the Co-base alloy for build-up welding, this may cause reduction in ductility of the alloy powder or reduction in flowability of the molten alloy.

Furthermore, there has not yet been proposed any case where a hardfacing alloy is endowed with both weld cracking sensitivity equal to or higher than that of the Co—Cr—W alloy and wear resistance equal to or higher than that of the Co—Cr—Mo—Si alloy.

Patent Document 1: JP-A-62-033090 (the term "JP-A" as used herein means an "unexamined published Japanese patent application")

Patent Document 2: JP-A-02-092495

Patent Document 3: JP-A-07-126782

Patent Document 4: JP-A-05-084592

Patent Document 5: JP-A-2001-123238

SUMMARY OF THE INVENTION

A problem to be solved by the present invention is to provide a high-hardness hardfacing alloy powder endowed with both weld cracking sensitivity equal to or higher than that of the Co—Cr—W alloy and wear resistance equal to or higher than that of the Co—Cr—Mo—Si alloy.

Another problem to be solved by the present invention is to provide a high-hardness hardfacing alloy powder capable of suppressing reduction in ductility of the alloy powder and reduction in flowability of the molten alloy.

In order to solve the above-mentioned problems, the present invention provides the following items.

1. A high-hardness hardfacing alloy powder, comprising:
$0.5<C\leq3.0$ mass %,
$0.5\leq Si\leq5.0$ mass %,
$10.0\leq Cr\leq30.0$ mass %, and
$16.0<Mo\leq40.0$ mass %,
with the balance being Co and unavoidable impurities,
wherein a total amount of Mo and Cr satisfies
$40.0\leq Mo+Cr\leq70.0$ mass %.

2. The high-hardness hardfacing alloy powder according to item 1 above, further comprising at least one element selected from the group consisting of:
$Ca\leq0.03$ mass %, and
$P\leq0.03$ mass %.

3. The high-hardness hardfacing alloy powder according to item 1 above, further comprising at least one element selected from the group consisting of:
$Ni\leq5.0$ mass %, and
$Fe\leq5.0$ mass %.

4. The high-hardness hardfacing alloy powder according to item 2 above, further comprising at least one element selected from the group consisting of:
$Ni\leq5.0$ mass %, and
$Fe\leq5.0$ mass %.

5. A high-hardness hardfacing alloy powder, consisting essentially of:
$0.5<C\leq3.0$ mass %,
$0.5\leq Si\leq5.0$ mass %,
$10.0\leq Cr\leq30.0$ mass %, and
$16.0<Mo\leq40.0$ mass %,
and optionally at least one element selected from the group consisting of:
$Ca\leq0.03$ mass %,
$P\leq0.03$ mass %,
$Ni\leq5.0$ mass %, and
$Fe\leq5.0$ mass %
with the balance being Co and unavoidable impurities,
wherein a total amount of Mo and Cr satisfies
$40.0\leq Mo+Cr\leq70.0$ mass %.

6. A high-hardness hardfacing alloy powder, consisting of:
$0.5<C\leq3.0$ mass %,
$0.5\leq Si\leq5.0$ mass %,
$10.0\leq Cr\leq30.0$ mass %, and
$16.0<Mo\leq40.0$ mass %,
and optionally at least one element selected from the group consisting of:
$Ca\leq0.03$ mass %,
$P\leq0.03$ mass %,
$Ni\leq5.0$ mass %, and
$Fe\leq5.0$ mass %
with the balance being Co and unavoidable impurities,
wherein a total amount of Mo and Cr satisfies
$40.0\leq Mo+Cr\leq70.0$ mass %.

The high-hardness hardfacing alloy powder according to the present invention exhibits wear resistance equal to or higher than that of the Co—Cr—Mo—Si alloy and weld cracking sensitivity equal to or higher than that of the Co—Cr—W alloy. This is considered because:

(1) by adding a predetermined amount of C to a Co—Cr—Mo—Si alloy, both a Laves phase and a Cr-based carbide are precipitated in the matrix, (2) by optimizing the Mo+Cr amount, the hardening phase production can be kept in a predetermined range, (3) by controlling the Si amount, the Laves phase precipitation can be controlled and in turn, the dissolved amount of Mo in the matrix can be controlled, and (4) Mo is also dissolved in the Cr-based carbide and in turn, compared with the conventional Co—Cr—Mo—Si alloy not containing C, the dissolved amount of Mo in the matrix is reduced.

Furthermore, since the high-hardness hardfacing alloy powder according to the present invention contains substantially no W, reduction in ductility of the alloy powder and reduction in flowability of the molten alloy can be suppressed.

BEST MODE FOR CARRYING OUT THE INVENTION

One embodiment of the present invention is described in detail below.

1. High-Hardness Hardfacing Alloy Powder 1.1 Principal Constituent Elements

The high-hardness hardfacing alloy powder according to the present invention contains the following elements, with the balance being Co and unavoidable impurities. The kinds of added elements, the elemental ranges thereof and the reasons for limitations are as follows.

(1) $0.5<C\leq3.0$ mass %:

C is an element necessary to form a carbide as a hardening phase by binding with Cr and thereby enhance the wear resistance. In order to obtain such an effect, the C content must be more than 0.5 mass %.

On the other hand, if the C content is excessive, the carbide production becomes excessive, and toughness of the alloy is reduced. For this reason, the C content must be 3.0 mass % or less. The C content is preferably 2.0 mass % or less.

(2) $0.5\leq Si\leq5.0$ mass %:

Si is an important element for forming a Laves phase ($Co_3Mo_2Si$) as a hard phase and thereby enhancing the wear resistance. In order to obtain such an effect, the Si content must be 0.5 mass % or more. The Si content is preferably 1.0 mass % or more.

On the other hand, if the Si content is excessive, the Laves phase production becomes excessive, and ductility of the alloy is reduced. For this reason, the Si content must be 5.0 mass % or less. The Si content is preferably 2.5 mass % or less.

(3) $10.0\leq Cr\leq30.0$ mass %:

Cr is an element necessary to form a Cr carbide and thereby enhance the wear resistance. Also, Cr is essential to ensure resistance against high-temperature oxidation and corrosion of the alloy. In order to obtain such effects, the Cr content must be 10.0 mass % or more.

On the other hand, if the Cr content is excessive, the carbide production becomes excessive, and ductility of the alloy is reduced. For this reason, the Cr content must be 30.0 mass % or less.

(4) $16.0<Mo\leq40.0$ mass %:

Mo is an important element for forming a Laves phase ($Co_3Mo_2Si$) as a hardening phase and thereby enhancing the wear resistance. In order to obtain such an effect, the Mo content must be more than 16.0 mass %. The Mo content is preferably 25.0 mass % or more.

On the other hand, if the Mo content is excessive, the Laves phase production becomes excessive, and ductility of the alloy is reduced. For this reason, the Mo content must be 40.0 mass % or less. The Mo content is preferably 35.0 mass % or less.

1.2. Sub-Constituent Elements

The high-hardness hardfacing alloy powder according to the present invention may further contain one or two or more of the following sub-constituent elements, in addition to the above-described principal constituent elements. The kinds of added elements, the elemental ranges thereof and the reasons for limitations are as follows.

1.2.1. Deoxidizing Element (5) Ca≤03 mass %:

(6) P≤0.03 mass %:

Both Ca and P are an element having a deoxidizing action during alloy ingot casting and therefore, may be added, if desired. However, if the contents of these element are excessive, the ductility is reduced. For this reason, each of the contents of Ca and P must be 0.03 mass % or less.

1.2.2. Element for Improving Flowability of Molten Alloy (7) Ni≤5.0 mass %:

Ni has an action of enhancing ductility of the alloy powder and flowability of the molten alloy and therefore, may be added, if desired. Also, Ni is an element having a possibility of being unavoidably mixed in an amount of about 1.0 mass % or less during the production of an alloy powder. In order to enhance ductility and flowability of the molten alloy, the Ni content is preferably 0.1 mass % or more.

On the other hand, if the Ni content is excessive, ductility of the alloy powder is reduced. For this reason, the Ni content must be 5.0 mass % or less. The Ni content is preferably 3.5 mass % or less.

(8) Fe≤5.0 mass %:

Fe has an action of binding with O to form an oxide, thereby enhancing lubricity of the alloy powder and at the same time, enhancing flowability of the molten alloy, and therefore, may be added, if desired. Also, Fe is an element having possibility of unavoidably being mixed in an amount of about 1.0 mass % during the production of an alloy powder.

On the other hand, if the Fe content is excessive, not only ductility of the alloy powder but also wear resistance are reduced. For this reason, the Fe content must be 5.0 mass % or less.

1.3. Unavoidable Impurities

The following unavoidable impurities are an element having a possibility of being accidentally mixed in a large amount from raw materials during the production of a powder. If these impurities are excessively mixed, a desired powder is not obtained and therefore, the contents thereof must be controlled as follows.

(9) Mn≤1.0 mass %:

Mn has a deoxidizing action, but if the Mn content exceeds 1.0 mass %, the flowability becomes worse and the weldability is reduced. For this reason, the Mn content must be 1.0 mass % or less.

(10) Cu≤1.0 mass %:

Cu has an action of increasing adherence of an oxide film of the alloy at a high temperature and thereby enhancing the oxidation resistance, but if the Cu content exceeds 1.0 mass %, ductility of the alloy is deteriorated. For this reason, the Cu content must be 1.0 mass % or less.

(11) S≤0.03 mass %:

S has an action of forming a sulfide and enhancing lubricity of the alloy powder, but if the S content exceeds 0.03 mass %, ductility of the alloy powder is reduced. For this reason, the S content must be 0.03 mass % or less.

(12) W<1.0 mass %:

W has an action of forming a carbide together with Cr and enhancing wear resistance of the alloy powder, but if the W content is 1.0 mass % or more, ductility of the alloy powder is reduced and at the same time, the flowability becomes worse. For this reason, the W content must be less than 1.0 mass %.

(13) O≤0.1 mass %:

O has an action of forming an oxide and enhancing lubricity of the alloy powder, but if the O content exceeds 0.1 mass %, ductility of the alloy powder is reduced. For this reason, the O content must be 0.1 mass % or less.

(14) N≤0.1 mass %:

N has an action of forming a nitride and enhancing wear resistance of the alloy powder, but if the N content exceeds 0.1 mass %, ductility of the alloy powder is reduced. For this reason, the N content must be 0.1 mass % or less.

1.4. Component Balance: Mo+Cr

In the high-hardness hardfacing alloy powder according to the present invention, in addition to the requirement that the amounts of the constituent elements are in the above-described ranges, the total amount of Mo and Cr (Mo+Cr amount) must be in the following range.

That is, Mo and Cr are elements capable of forming a Laves phase and a Cr carbide, respectively. If the Mo+Cr amount is small, the hardening phase production is decreased and wear resistance of the alloy powder is reduced. For this reason, the Mo+Cr amount must be 40.0 mass % or more.

On the other hand, if the Mo+Cr amount is excessive, the hardening phase production becomes excessive and ductility of the alloy is reduced. For this reason, the Mo+Cr amount must be 70.0 mass % or less. The Mo+Cr amount is preferably 60.0 mass % or less.

2. Production Method of High-Hardness Hardfacing Alloy Powder

The high-hardness hardfacing alloy powder according to the present invention can be produced by:

(1) melting raw materials blended to give a predetermined composition, and (2) spraying the molten alloy in a gas or a liquid.

3. Action of High-Hardness Hardfacing Alloy Powder

The high-hardness hardfacing alloy powder according to the present invention exhibits wear resistance equal to or higher than that of the Co—Cr—Mo—Si alloy and weld cracking sensitivity equal to or higher than that of the Co—Cr—W alloy. This is considered because:

(1) by adding a predetermined amount of C to a Co—Cr—Mo—Si alloy, both a Laves phase and a Cr-based carbide are precipitated in the matrix, (2) by optimizing the Mo+Cr amount, the hardening phase production can be kept in a predetermined range, (3) by controlling the Si amount, the Laves phase precipitation can be controlled and in turn, the dissolved amount of Mo in the matrix can be controlled, and (4) Mo is also dissolved in the Cr-based carbide and in turn, compared with the conventional Co—Cr—Mo—Si alloy not containing C, the dissolved amount of Mo in the matrix is reduced.

Furthermore, since the high-hardness hardfacing alloy powder according to the present invention contains substantially no W, reduction in ductility of the alloy powder and reduction in flowability of the molten alloy can be suppressed.

EXAMPLES

Examples 1 to 13 and Comparative Examples 1 to 11

1. Production of Samples

An alloy powder having each composition shown in Table 1 was produced by spraying in a gas. The powder particle size was −80/+350 mesh. The surface of an SUH 35-made plate material (15 mm (thickness)×70 mm (width)×150 mm (length)) was hardfaced by welding each alloy powder under the following conditions. Also, the face part of an SUH 35-made valve (100 valves) was hardfaced by welding each alloy powder.

Hardfacing Conditions (One Build-Up Layer)

Current value: 105 A
Supply amount of powder: 12 g/min
Welding speed: 50 mm/min,
Amount of weaving: 1 mm
Ar Flow rate:
plasma gas: 1 L/min
shield gas: 12 L/min
powder gas: 2.5 L/min (length). By using this specimen, a tensile test was performed at 600° C., and the elongation value after breaking was measured.

2.3. Observation of Crack after Welding

The appearance of the hardfaced part of the valve was observed and the presence or absence of a crack was examined. The result was rated "A" when a crack was not observed, rated "B" when the number of cracks was less than 5, and rated "C" when the number of cracks was 5 or more.

2.4. Abrasion Loss after Unit Wear Test

A unit wear test was performed under the following conditions. The abrasion loss of the surface after the test, where the valve and a valve seat were disposed, was measured. The result was rated "A" when the abrasion loss was less than 15 μm, and rated "B" when the abrasion loss was 15 μm or more.

TABLE 1

| | Composition (mass %) | | | | | | | |
|---|---|---|---|---|---|---|---|---|
| | C | Si | Cr | Mo | Co | Mo + Cr | Other Added Elements | Impurity Element |
| Example 1 | 0.52 | 2.58 | 22.1 | 27.5 | bal. | 49.6 | | |
| Example 2 | 0.93 | 2.11 | 22.0 | 26.3 | bal. | 48.3 | | |
| Example 3 | 1.43 | 1.66 | 22.7 | 25.1 | bal. | 47.8 | | |
| Example 4 | 1.82 | 1.24 | 21.7 | 23.7 | bal. | 45.4 | | |
| Example 5 | 2.36 | 0.92 | 20.3 | 24.8 | bal. | 45.1 | | |
| Example 6 | 2.73 | 0.58 | 23.6 | 25.6 | bal. | 49.2 | Ni: 3.1% | Mn: 0.7% |
| Example 7 | 1.91 | 1.18 | 11.2 | 29.1 | bal. | 40.3 | | Cu: 0.8%<br>S: 0.018% |
| Example 8 | 1.83 | 1.02 | 28.9 | 23.2 | bal. | 52.1 | Ca: 0.012%<br>P: 0.025% | |
| Example 9 | 1.88 | 1.34 | 29.2 | 16.4 | bal. | 45.6 | | W: 0.7% |
| Example 10 | 1.92 | 1.12 | 20.3 | 37.1 | bal. | 57.4 | | O: 0.08% |
| Example 11 | 1.93 | 1.27 | 28.1 | 37.3 | bal. | 65.4 | Fe: 2.6% | N: 0.07% |
| Example 12 | 1.23 | 3.26 | 21.9 | 30.8 | bal. | 52.7 | | |
| Example 13 | 1.18 | 4.31 | 20.9 | 33.2 | bal. | 54.1 | | |
| Comparative Example 1 | — | 2.74 | 8.1 | 29.3 | bal. | 37.4 | | |
| Comparative Example 2 | 1.21 | 1.07 | 28.6 | — | bal. | 28.6 | W: 4.5% | |
| Comparative Example 3 | 0.27 | 1.62 | 23.9 | 24.7 | bal. | 48.6 | | |
| Comparative Example 4 | 3.42 | 1.75 | 27.1 | 24.1 | bal. | 51.2 | | |
| Comparative Example 5 | 1.53 | 0.31 | 25.4 | 23.5 | bal. | 48.9 | | |
| Comparative Example 6 | 1.49 | 5.78 | 26.3 | 26.3 | bal. | 52.6 | | |
| Comparative Example 7 | 1.63 | 1.32 | 8.4 | 38.5 | bal. | 46.9 | | |
| Comparative Example 8 | 1.82 | 1.23 | 36.9 | 14.2 | bal. | 51.1 | | |
| Comparative Example 9 | 1.76 | 1.19 | 37.3 | 7.9 | bal. | 45.2 | | |
| Comparative Example 10 | 1.53 | 1.45 | 11.9 | 47.9 | bal. | 59.8 | | |
| Component Example 11 | 1.39 | 1.48 | 18.6 | 16.3 | bal. | 34.9 | | |

2. Test Method 2.1. Vickers Hardness

The build-up welded plate material was cut nearly perpendicularly to the weld bead. The Vickers hardness at the center in the cross-section of the build-up layer was measured at 7 points by applying a weight of 1 kgf (9.8 N). The average value of 5 points excluding the maximum value and the minimum value was calculated.

2.2. Tensile Test

A specimen where the mark-to-mark spacing was composed of only a build-up layer was cut out from the build-up welded plate material. The dimension of the mark-to-mark spacing was 2 mm (thickness)×4 mm (width)×10 mm Testing time: 10 h
Fuel: LPG
Number of contacts: 3,000 contacts/min
Valve driving: crank shaft
Number of valve rotations: 10 rotations/min

3. Results

The results are shown in Table 2. The results in Table 2 reveal the followings.

(1) In Comparative Example 1 having a composition corresponding to TRIBALOY (registered trademark) 400, the hardness is high but the elongation is low and many cracks are observed after welding.

(2) In comparative Example 2 having a composition corresponding to STELLITE (registered trademark) #6, the elongation is high and cracks after welding are not observed, but the hardness is low and the abrasion loss is large.

(3) In Comparative Example 3 where the C content is small, cracks after welding are not observed, but the abrasion loss is large. On the other hand, in Comparative Example 4 where the C content is excessive, the abrasion loss is small, but many cracks are observed after welding.

(4) In Comparative Example 5 where the Si content is small, cracks after welding are not observed, but the abrasion loss is large. On the other hand, in Comparative Example 6 where the Si content is excessive, the abrasion loss is small, but many cracks are observed after welding.

(5) In Comparative Example 7 where the Mo content is large and the Cr content is small, the abrasion loss is small but many cracks are observed after welding. On the other hand, in Comparative Examples 8 and 9 where the Mo content is small and the Cr content is excessive, cracks after welding are not observed, but the abrasion loss is large.

(6) In Comparative Example 11 where the Mo+Cr amount is small, cracks after welding are not observed but the abrasion loss is large.

(7) In all of Examples 1 to 13 where each component is optimized and the Mo+Cr amount is also optimized, cracks after welding are reduced and the abrasion loss is also small.

(8) In Examples 5 and 6 where the C content exceeds 2.0 mass %, cracks after welding are slightly observed. In this connection, when the C content is set to be from more than 0.5 mass % to 2.0 mass % while keeping other components the same, cracks after welding can be eliminated while maintaining the abrasion loss in the same level.

(9) In Examples 12 and 13 where the Si content greatly exceeds 2.5 mass %, cracks after welding are slightly observed. In this connection, when the Si content is set to be from 1.0 to 2.5 mass % while keeping other components the same, cracks after welding can be eliminated while maintaining the abrasion loss in the same level.

(10) In Example 9 where the Mo content is 16.4 mass %, the Vickers hardness is slightly low. Also, in Examples 10 and 11 where the Mo content exceeds 35 mass %, cracks after welding are slightly observed. In this connection, when the Mo content is set to be from 25 to 35 mass % while keeping other components the same, the Vickers hardness can be increased or cracks after welding can be eliminated while maintaining the abrasion loss in the same level.

(11) It is seen from Examples 6, 7 and 9 to 11, even when Mn, Cu or the like is slightly mixed as an impurity, predetermined characteristics can be maintained.

TABLE 2

| | Vickers Hardness | Elongation/% | Cracks after Welding | Abrasion Loss After Actual Machine Test |
|---|---|---|---|---|
| Example 1 | 513 | 4.1 | A | A |
| Example 2 | 532 | 4.3 | A | A |
| Example 3 | 549 | 3.8 | A | A |
| Example 4 | 622 | 4.0 | A | A |
| Example 5 | 639 | 3.4 | B | A |
| Example 6 | 652 | 3.2 | B | A |
| Example 7 | 649 | 2.9 | A | A |
| Example 8 | 587 | 3.8 | A | A |
| Example 9 | 571 | 4.6 | A | A |
| Example 10 | 623 | 3.3 | B | A |
| Example 11 | 658 | 2.7 | B | A |
| Example 12 | 682 | 2.4 | B | A |
| Example 13 | 695 | 2.1 | B | A |

TABLE 2-continued

| | Vickers Hardness | Elongation/% | Cracks after Welding | Abrasion Loss After Actual Machine Test |
|---|---|---|---|---|
| Comparative Example 1 | 638 | 0.0 | C | A |
| Comparative Example 2 | 418 | 4.9 | A | B |
| Comparative Example 3 | 422 | 4.2 | A | B |
| Comparative Example 4 | 681 | 0.0 | C | A |
| Comparative Example 5 | 418 | 3.7 | A | B |
| Comparative Example 6 | 673 | 0.0 | C | A |
| Comparative Example 7 | 685 | 0.0 | C | A |
| Comparative Example 8 | 462 | 2.9 | A | B |
| Comparative Example 9 | 438 | 4.5 | A | B |
| Comparative Example 10 | 674 | 0.0 | C | A |
| Component Example 11 | 421 | 3.2 | A | B |

While the invention has been described in detail and with reference to specific embodiments thereof, it will be apparent to one skilled in the art that various changes and modifications can be made therein without departing from the spirit and scope thereof.

This application is based on Japanese patent application No. 2011-104318 filed May 9, 2011, the entire contents thereof being hereby incorporated by reference.

The high-hardness hardfacing alloy powder according to the present invention can be employed for build-up welding of a face part of a valve used in various internal combustion engines, automotive engines, steam turbines, heat exchangers, heating furnaces and the like.

What is claimed is:

1. A high-hardness hardfacing alloy powder, comprising:

$1.18 \leq C \leq 3.0$ mass %, $0.5 \leq Si \leq 5.0$ mass %, $10.0 \leq Cr \leq 30.0$ mass %, and $16.0 < Mo \leq 40.0$ mass %, with the balance being Co and unavoidable impurities, wherein a total amount of Mo and Cr satisfies $40.0 \leq Mo+Cr \leq 70.0$ mass % and a matrix of the high-hardness facing powder has both a Laves phase and a Cr-based carbide.

2. The high-hardness hardfacing alloy powder as claimed in claim 1, further comprising at least one element selected from the group consisting of:

$Ca \leq 0.03$ mass %, and $P \leq 0.03$ mass %.

3. The high-hardness hardfacing alloy powder as claimed in claim 1, further comprising at least one element selected from the group consisting of:

$Ni \leq 5.0$ mass %, and $Fe \leq 5.0$ mass %.

4. The high-hardness hardfacing alloy powder as claimed in claim 2, further comprising at least one element selected from the group consisting of:

$Ni \leq 5.0$ mass %, and $Fe \leq 5.0$ mass %.

5. A high-hardness hardfacing alloy powder, consisting essentially of:

1.18≤C≤3.0 mass %,
0.5≤Si≤5.0 mass %,
10.0≤Cr≤30.0 mass %, and
16.0<Mo≤40.0 mass %,
and optionally at least one element selected from the group consisting of:
Ca≤0.03 mass %,
P≤0.03 mass %,
Ni≤5.0 mass %, and
Fe≤5.0 mass %
with the balance being Co and unavoidable impurities, wherein
a total amount of Mo and Cr satisfies
40.0≤Mo+Cr≤70.0 mass % and
a matrix of the high-hardness facing powder has both a Laves phase and a Cr-based carbide.

6. A high-hardness hardfacing alloy powder, consisting of:
1.18<C≤3.0 mass %,
0.5≤Si≤5.0 mass %,
10.0≤Cr≤30.0 mass %, and
16.0<Mo≤40.0 mass %,
and optionally at least one element selected from the group consisting of:
Ca≤0.03 mass %,
P≤0.03 mass %,
Ni≤5.0 mass %, and
Fe≤5.0 mass %
with the balance being Co and unavoidable impurities, wherein a total amount of Mo and Cr satisfies
40.0≤Mo+Cr≤70.0 mass % and
a matrix of the high-hardness facing powder has both a Laves phase and a Cr-based carbide.

* * * * *